United States Patent [19]

Mull

[11] Patent Number: 4,854,933

[45] Date of Patent: Aug. 8, 1989

[54] PLASMA SEPARATOR

[76] Inventor: John D. Mull, 4088 Lakeshore Road East, Burlington, Ontario, Canada, L7L 1A1

[21] Appl. No.: 104,915

[22] Filed: Oct. 6, 1987

[51] Int. Cl.[4] ..... B04B 1/06

[52] U.S. Cl. ..... 494/38; 494/24; 494/44; 494/45

[58] Field of Search ..... 494/1, 24, 38, 43–45, 494/65; 206/221, 219, 307

[56] References Cited

U.S. PATENT DOCUMENTS

| | | | |
|---|---|---|---|
| 3,239,136 | 3/1966 | Hein | 494/45 X |
| 3,485,445 | 12/1969 | Engel | 494/65 X |
| 4,111,355 | 9/1978 | Ishimaru | 494/45 X |
| 4,142,670 | 3/1979 | Ishimaru et al. | 494/38 |
| 4,177,921 | 12/1979 | Nielsen | 494/38 X |
| 4,458,812 | 7/1984 | Dreier et al. | 494/38 X |

*Primary Examiner*—Timothy F. Simone

*Attorney, Agent, or Firm*—Rogers, Bereskin & Parr

[57] ABSTRACT

A plasma separator for receiving a blood sample includes a central chamber of inverted conical shape and an outer annular chamber connected to the central chamber by a downwardly inclined passageway. The separator is designed to be rotated at high speed about a vertical axis so that red blood cells in the sample migrate down the passageway and into the outer chamber, leaving clear plasma in the central chamber that can then be removed by pipette.

6 Claims, 1 Drawing Sheet

PLASMA SEPARATOR

FIELD THE INVENTION

This invention relates generally to a device for separating plasma from red cells (erythrocytes) in blood samples.

BACKGROUND OF THE INVENTION

Various blood analysis techniques require clear plasma samples free of red cells. Separation of plasma from red cells can be accomplished by various methods based on the fact that the red cells are of a higher specific gravity than the plasma. For example, if a blood sample can be allowed to stand for two or more days, the red blood cells will settle to the bottom by gravity. A faster technique is centrifugation using an ordinary laboratory centrifuge. In routine laboratory analysis, a centrifugation step does not delay the work flow. However, centrifugation does take some time (20 minutes or so) and may be unacceptable in an emergency situation, for example in an operating room. Even in non-emergency situations such as in a doctor's office, it may be desirable for the doctor himself or an assistant to be able to quickly obtain a clear plasma sample without having to send the blood sample to a laboratory.

DESCRIPTION OF THE PRIOR ART

Centrifuge devices comprising a rotor that rotates at high speed about a vertical axis have been proposed for clearing blood samples of chylomicrons (fat particles 80–500 nm diameter) prior to clinical analysis. Devices of this type are available from Beckman Instruments, Inc. of California and are described in (Ishimaru et al.) U.S. Pat. No. 4,142,670 issued Mar. 6, 1979 and (Nielsen) U.S. Pat. No. 4,177,921 issued Dec. 11, 1979. Both of these patents have been assigned to Beckman Instruments, Inc.

The Beckman chylomicron rotor receives a disposable liner in which chylomicrons are isolated by flotation. The liner has a cylindrical centre chamber and a doughnut-shaped outer chamber. The liner is made of a thin and flexible polyethylene material and flexes substantially under centrifugal force during centrifugation while being constrained by the rotor. At this time, the chylomicrons float to the centre of the liner where they are isolated. The serum can then be removed from the liner by pipette.

BRIEF DESCRIPTION OF THE INVENTION

The invention provides a plasma separator comprising a container which is symmetrical about a normally vertical axis and which is adapted for coupling to a device capable of rotating the container at high speed about the said axis. The container is self-supporting during such rotation and defines internally a central chamber for receiving a blood sample, an annular outer chamber for receiving red blood cells separated out of the sample by rotation about said axis, and an annular passageway connecting the chambers. The central chamber has a lower wall of inverted conical shape extending to a circular edge at an upper end of the wall and at an inner and of the said passageway. The passageway extends downwardly and outwardly from the said edge to the outer chamber, the outer chamber being located at an outer end of the passageway and below the said circular edge. The container has a single opening located in a top wall above the central chamber of a size sufficient only to permit insertion of a blood sample into and removal of plasma from the central chamber.

In use, a blood sample is introduced into the central chamber through the opening in the top wall of the container, for example by pipette or syringe. The container is then placed on the rotating device and is self-supporting while being rotated about its vertical axis. It is believed that, during such rotation, the red blood cells are caused to migrate outwardly by centrifugal force and up the inclined surface provided by the inverted conical bottom wall of the chamber. The cells then migrate outwardly and downwardly through the passageway and into the outer annular chamber, leaving clear plasma in the central chamber. In experiments, it has been found that a clear plasma sample can be obtained in the order of 30 seconds.

It is believed that the inverted conical shape of the bottom wall of the central chamber is important in promoting migration of the red blood cells towards the outer chamber. At the same time, the location and orientation of the passageway inhibits return of the red cells and remixing with the plasma and central chamber after rotation has ceased.

BRIEF DESCRIPTION OF THE DRAWINGS

In order that the invention may be more clearly understood, reference will now be made to the accompanying drawings which illustrate particular preferred embodiments of the invention by way of example, and in which.

DESCRIPTION OF THE PREFERRED EMBODIMENTS

Figure 1:
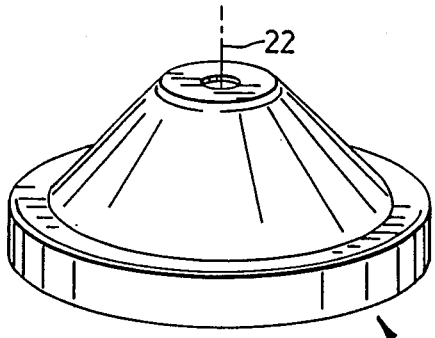
FIG. 1 is a perspective view from above of a plasma separator in accordance with the invention.

Referring now to the drawings, FIG. 1 shows the external appearance of the plasma separator provided by the invention, as seen from above. In this embodiment, the separator is made in one piece in a semi-rigid plastic material, for example by blow-moulding. In an alternative embodiment, however, the separator could be made in two or more parts.

Figure 2:
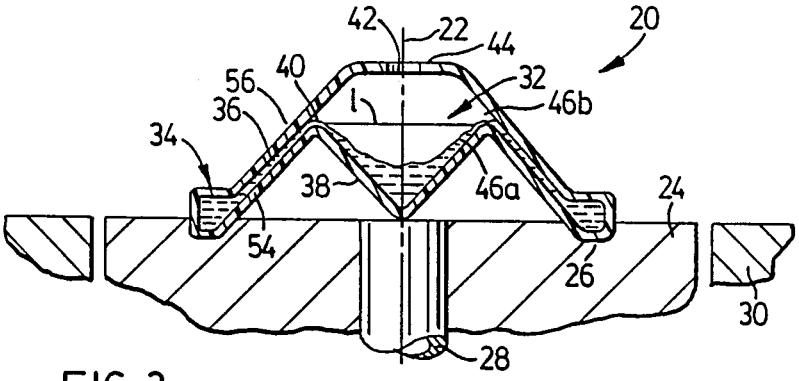
FIG. 2 is a vertical sectional view through the central axis of the separator shown in FIG. 1, with the separator shown mounted on a device for rotating the separator.

The separator itself is generally denoted by reference numeral 20 and essentially comprises a container which is symmetrical about a normally vertical axis 22. The container is designed so that it can be coupled to a device that is capable of rotating the container at high speed about axis 22. In FIG. 2, part of such a device is shown supporting the separator. The device comprises a platform 24 having a recess 26 into which the separator is frictionally engaged. The platform 24 is carried by a vertical shaft 28 that is connected to a drive motor (not shown) for rotating the shaft and with it the separator at high speed. The structure surrounding the platform 24 is indicated at 30.

The container is designed to be self-supporting during rotation and, to this end, is made of a semi-rigid plastic material as noted previously. The container defines internally a central chamber 32 for receiving a blood sample, and an annular outer chamber 34 for receiving red blood cells separated out of the blood sample by rotation of the container about axis 22. An annular passageway 36 connects the two chambers 32 and 34.

The central chamber 32 has a lower wall 38 of inverted conical shape extending to a circular edge 40 at an upper end of wall 38 and at the inner end of passageway 36. The passageway extends downwardly and outwardly from edge 40 to the outer chamber 34, which chamber is located at the outer end of the passageway and below the circular edge 40. The container has a single opening 42 located in a top wall 44 above the central chamber for permitting insertion of a blood sample into and removable of plasma from the chamber.

In practice, a blood sample will typically be introduced into the central chamber 32 through opening 42 by means of a pipette. Preferably, the central chamber will be filled to the level of edge 40 as indicated by the level line "1" in FIG. 2. The container will be frictionally retained in the recess 26 in platform 24 sufficiently tightly that the container will stay in place when the platform is rotated at high speed. At this time, red cells in the blood sample will tend to migrate up the inclined inner surface of wall 38 as shown generally at **46*a* in FIG. 2, over edge 40 as indicated at 46*a* and down the passageway 36 into chamber 34**.

Preferably, the plasma separator will be made of a transparent or transluscent plastic material so that the sample can be visually observed during rotation of the separator. The person operating the device on which the separator is rotated can then stop rotation when substantially all of the red cells appear to have migrated into the outer chamber 34.

Figure 3:
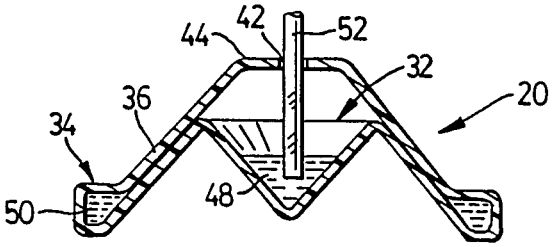
FIG. 3 is a view similar to FIG. 2 illustrating removal of a separated plasma sample from the central chamber of the separator; and, FIG. 4 is a view similar to FIG. 2 (but without the rotary device) illustrating an alternative embodiment of the invention.

FIG. 3 shows the plasma separator after it has been removed from platform 24 when separation has been completed. Clear plasma indicated by reference numeral 48 remains in the central chamber 32 while the outer chamber 34 contains red blood cells indicated at 50. The stem of a pipette is shown at 52 as having been inserted through opening 42 for withdrawing the plasma sample from chamber 32. Normally, the red blood cells 50 would not be required for analysis and would be simply discarded. It is anticipated that the separator will be disposable so that it can be simply thrown away after the plasma has been removed from chamber 32. On the other hand, if it is desired to either retrieve the red cells or reuse the separator, then the red cells can be transferred into the central chamber by appropriately tipping the separator and the red cells can then be removed by pipette.

From a comparison of FIGS. 2 and 3 it will be noted that the walls of the container that define the passageway 36 are shown spaced apart somewhat in FIG. 2 but in contact in FIG. 3. Thus, the container is designed so that the walls that define passageway 36 will tend to move apart under centrifugal force to allow liquid flow through passageway 36 during rotation of the separator, but will close to in effect isolate the red cells from the plasma sample when the separator is stationary. Referring specifically to FIG. 2, the container has a wall 54 at the inner side of passageway 36 that remains relatively stationary under the effects of centrifugal force due to the bracing effect of the inverted conical wall 38. The wall 56 at the outer side of passageway 36 on the other hand is designed to be more flexible and to move away from wall 54 under the effect of centrifugal force.

Figure 4:
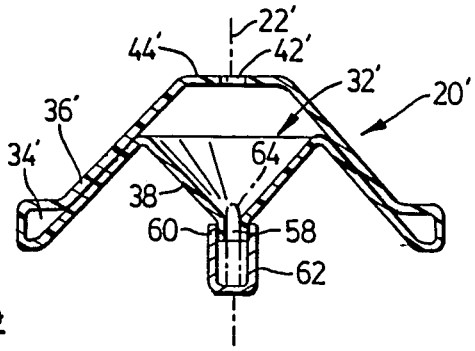

FIG. 4 shows an alternative embodiment of the invention in which primed reference numerals have been used to denote parts corresponding to parts shown in the previous views. In this case, the container forming the separator is essentially the same as the container shown in the previous views except in that an outlet for plasma is provided at the centre of the bottom wall 38 of chamber 32. In FIG. 4, the outlet is denoted by reference numeral 58 and is surrounded by a short neck 60 over which is frictionally fitted an inverted cap 62 that acts as a collection chamber for the plasma. In this embodiment, when the separation of plasma from red blood cells has been completed, all that need be done is to remove the cap 62, containing the plasma. The step of inserting a pipette to remove the plasma is unnecessary. Opening 42' is still provided in the top wall 44 of the container for the purpose of introducing a blood sample into the container. The sample would be introduced at a location off axis 22' while the separator is rotating. Alternatively, cap 62 may be provided with a plug for outlet 58 as indicated in ghost outline at 64 in FIG. 4.

The device used to rotate the plasma separator need not be a high quality laboratory-standard centrifuge as is required in the prior art, although such a device could undoubtedly be used for this purpose. All that is required is a drive means that is capable of engaging and rotating the separator at relatively high speed. It should also be noted that the separator is self-supporting during rotation and that it is unnecessary to confine the separator within some sort of rotor structure as in the prior art.

In summary, the device provided by the invention provides ah extremely simple and inexpensive means for separating plasma from a blood sample, quickly and efficiently. Numerous other advantages are also provided by the device. For example, in terms of safety, no handling of the blood sample is required. The separator can be made of a plastic material so that there is no glass that might break. At the same time, the separator can be made transparent so that the blood separation action is visible and the separator can be made relatively inexpensively so that it can be disposable. Unlike blood separation techniques performed using a centrifuge, balancing of the rotary device is not a concern. Also, aerosoling of the sample is minimized because the sample is substantially closed by the separator.

Other advantages are that the separator can be used to "harvest" plasma by adding one blood sample after another to a large size separator.

The separators can also be made stackable so that multiple units can be stacked on the same spinner.

It will of course be understood that the preceding description relates to particular preferred embodiments of the invention only and that the invention is not limited to these embodiments.

I claim:

1. A plasma separator comprising a container having an axis, the container being symmetrical about said axis and being adapted for rotation at high speed about said axis with the container oriented so that the axis is vertical, the container being self supporting during such rotation and defining internally a central chamber for receiving a blood sample, an annular outer chamber, and an annular passageway connecting said chamber and having respective inner and outer ends, the central chamber having a top wall and a lower wall of inverted conical shape extending about said axis, the lower wall having an upper end and a circular edge at said upper end, said circular edge being disposed at said inner end of said passageway, the passageway extending downwardly and outwardly from said edge to said outer chamber, said outer chamber being located at said outer end of said passageway and below said circular edge, the inverted conical shape of the lower wall of the central chamber providing an internal surface of said central chamber which extends upwardly away from said axis to said circular edge at an inclination selected to permit red blood cells in a said blood sample to migrate up said surface, through said annular passageway, and into said outer chamber upon said rotation of the container at an appropriate said high speed, while plasma is retained in said inner chamber, the container having a single opening located in said top wall for permitting insertion of a blood sample into and removal of plasma from said central chamber.

2. A plasma separator as claimed in claim 1, wherein said container is a one-piece moulding in a plastic material.

3. A plasma separator as claimed in claim 1, wherein said container is shaped to define an annular structure extending below said lower wall of inverted conical shape and defining part of said outer chamber, said annular structure being shaped to be frictionally received in a complimentary recess in said device capable of rotating the container a high speed.

4. A plasma separator as claimed in claim 1, wherein said passageway is defined by inner and outer walls of the container which are normally in contact, and wherein the container is designed to flex under the effect of centrifugal force to permit said walls to move apart and open the passageway for liquid flow therealong.

5. A plasma separator as claimed in claim 1, wherein wherein said lower wall of inverted conical shape has an opening at its centre surrounded by a neck to which is frictionally coupled a cap forming a collecting chamber for plasma that has drained from said central chamber.

6. A method of separating plasma from red cells in a blood sample, the method comprising the steps of:

providing a transparent container having an axis, the container being symmetrical about said axis and being self supporting, the container defining internally a centrally chamber, an annular outer chamber and an annular passageway connecting said chambers and having respective inner and outer ends, the central chamber having a top wall and a lower wall of inverted conical shape extending about said axis, the lower wall having an upper end and a circular edge at said upper end, said circular edge being disposed at said inner end of said passageway, the passageway extending downwardly and outwardly from said edge to said outer chamber, said outer chamber being located at said outer end of said passageway and below said circular edge, the container having a single opening located in said top wall for providing access to said central chamber;

inserting a said blood sample into said central chamber through said opening in the top wall;

rotating the container about said axis with the axis vertical at a speed selected to cause red cells in said blood sample to migrate up said lower wall, through said annular passageway, and into said outer chamber, while plasma is retained in said inner chamber;

visually monitoring the container and terminating said rotation when the plasma in said inner chamber is seen to be substantially clear;

removing plasma from said central chamber through said opening in said top wall of said chamber.

* * * * *